US009206669B2

(12) United States Patent
Holderman

(10) Patent No.: US 9,206,669 B2
(45) Date of Patent: Dec. 8, 2015

(54) APPARATUS, SYSTEMS AND METHODS FOR A FLOW CONTROL DEVICE

(71) Applicant: Halliburton Energy Services, Inc., Houston, TX (US)

(72) Inventor: Luke William Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 432 days.

(21) Appl. No.: 13/784,775

(22) Filed: Mar. 4, 2013

(65) Prior Publication Data

US 2013/0276901 A1 Oct. 24, 2013

Related U.S. Application Data

(63) Continuation of application No. PCT/US2012/034013, filed on Apr. 18, 2012.

(51) Int. Cl.

| | |
|---|---|
| ***E21B 34/08*** | (2006.01) |
| ***E21B 43/12*** | (2006.01) |
| ***E21B 33/064*** | (2006.01) |
| ***E21B 34/10*** | (2006.01) |

(52) U.S. Cl.

CPC ..... *E21B 34/08* (2013.01); *E21B 33/064* (2013.01); *E21B 34/103* (2013.01); *E21B 43/12* (2013.01); *Y10T 137/0379* (2015.04); *Y10T 137/7762* (2015.04)

(58) Field of Classification Search

CPC ..... E21B 34/08

See application file for complete search history.

(56) References Cited

U.S. PATENT DOCUMENTS

| | | | | |
|---|---|---|---|---|
| 8,291,985 | B2 | 10/2012 | Holderman | |
| 2008/0135249 | A1 | 6/2008 | Fripp et al. | |
| 2009/0288838 | A1* | 11/2009 | Richards | 166/374 |
| 2011/0036565 | A1 | 2/2011 | Holderman et al. | |
| 2011/0056677 | A1 | 3/2011 | Holderman | |
| 2011/0083860 | A1 | 4/2011 | Gano et al. | |
| 2011/0247833 | A1 | 10/2011 | Todd et al. | |
| 2011/0253391 | A1* | 10/2011 | Veit et al. | 166/386 |
| 2012/0048561 | A1 | 3/2012 | Holderman | |
| 2012/0048563 | A1 | 3/2012 | Holderman | |
| 2012/0061102 | A1 | 3/2012 | Holderman et al. | |
| 2012/0160478 | A1 | 6/2012 | Todd et al. | |
| 2012/0181036 | A1 | 7/2012 | Holderman | |
| 2013/0037276 | A1 | 2/2013 | Kuo et al. | |
| 2013/0213667 | A1 | 8/2013 | Lopez et al. | |
| 2013/0220632 | A1 | 8/2013 | Greci et al. | |
| 2013/0276901 | A1 | 10/2013 | Holderman | |
| 2013/0277059 | A1 | 10/2013 | Holderman et al. | |
| 2014/0000869 | A1 | 1/2014 | Holderman et al. | |
| 2014/0027104 | A1 | 1/2014 | Holderman | |

* cited by examiner

*Primary Examiner* — Giovanna C Wright

(74) *Attorney, Agent, or Firm* — Scott Richardson; Baker Botts L.L.P.

(57) ABSTRACT

A flow control device for control of fluid flow through a tubular member comprises a control chamber having a piston disposed therein, where the piston is moveable from an open piston position to a closed piston position by the application of a first fluid pressure, and a valve chamber having a valve therein, where the valve is moveable from a closed valve position to an open valve position by the application of a second fluid pressure. A seal preventing fluid flow through the control chamber into the tubular member is formed in the closed piston position, and a flow path through the valve chamber and into the tubular member is formed in the open valve position.

19 Claims, 7 Drawing Sheets

APPARATUS, SYSTEMS AND METHODS FOR A FLOW CONTROL DEVICE

CROSS-REFERENCE TO RELATED APPLICATIONS

This application is a continuation of and claims priority under 35 U.S.C. §120 to International Application No. PCT/US2012/034013 filed on Apr. 18, 2012, entitled, "Apparatus, Systems and Methods for a Flow Control Device", by Luke W. Holderman, which is incorporated herein by reference in its entirety for all purposes.

STATEMENT REGARDING FEDERALLY SPONSORED RESEARCH OR DEVELOPMENT

Not applicable.

BACKGROUND

The disclosure relates generally to equipment utilized and operations performed in conjunction with a subterranean well and, more particularly, to the application of flow control devices to manage fluid flow into and out of a tubular body.

Without limiting the scope of the disclosure, its background will be described with reference to producing fluid from a hydrocarbon bearing subterranean formation, as an example.

During the production of hydrocarbons from a subterranean well, it is desirable to substantially reduce or exclude the production of water produced from the well. For example, it may be desirable for the fluid produced from the well to have a relatively high proportion of hydrocarbons, and a relatively low proportion of water. In some cases, it is also desirable to restrict the production of hydrocarbon gas from a well.

In addition, where fluid is produced from a long interval of a formation penetrated by a wellbore, it is known that balancing the production of fluid along the interval can lead to reduced water and gas "coning," and more controlled conformance, thereby increasing the proportion and overall quantity of oil produced from the interval. Inflow control devices (ICDs) have been used in the past to restrict flow of produced fluid through the ICDs for the purpose of balancing production along an interval. For example, in a long horizontal wellbore, fluid flow near the "heel" of the wellbore may be more restricted as compared to fluid flow near a "toe" of the wellbore, to counteract a horizontal well's tendency to produce at a higher flow rate at the "heel" of the well as compared to the "toe."

However, after the onset of water or gas production in the well due to coning, it is sometimes desirable to reduce any flow restrictions created by the ICDs in order to maximize production. Thus, while ICDs are desirable for delaying the point when water or gas production begins, higher flow rates into the well may be needed after this point in time in order to extract any remaining hydrocarbons from the surrounding formation. Further, it may also be desirable to isolate the well from the surrounding formation without the need for physical intervention into the well, such as for setting particular tools in the well or for abandoning the well.

SUMMARY

In an embodiment, a flow control device comprises a tubular member having an interior passageway for conveying fluids, a housing disposed about the tubular member and forming a chamber between the housing and the tubular member, where the housing is divided into a control chamber and a valve chamber, a piston disposed within the control chamber and moveable between a first piston position and a second piston position that is displaced from the first piston position, where the piston divides the control chamber into first and second portions, and a valve disposed within the valve chamber and moveable between a first valve position and a second valve position that is displaced from the first valve position, where the valve provides for selective fluid communication between a first portion of the valve chamber and a second portion of the valve chamber. The piston provides a first flow path between the control chamber and interior passageway of the tubular member in the first piston position, and the valve provides a second flow path between the valve chamber and interior passageway of the tubular member in the second valve position.

In an embodiment, a flow control device for control of fluid flow through a tubular member comprises a control chamber having a piston disposed therein, where the piston is moveable from an open piston position to a closed piston position by the application of a first fluid pressure, and a valve chamber having a valve therein, where the valve is moveable from a closed valve position to an open valve position by the application of a second fluid pressure. A seal preventing fluid flow through the control chamber into the tubular member is formed in the closed piston position, and a flow path through the valve chamber and into the tubular member is formed in the open valve position.

In an embodiment, a method for controlling flow into a tubular member comprises providing fluid communication between an interior of the tubular member and a subterranean formation along a first flow path, substantially sealing the first flow path in response to a first pressure, establishing a second flow path between the interior of the tubular member and the subterranean formation in response to a second pressure, and providing fluid communication between the interior of the tubular member and the subterranean formation along the second flow path.

These and other features and characteristics will be more clearly understood from the following detailed description taken in conjunction with the accompanying drawings and claims.

BRIEF DESCRIPTION OF THE DRAWINGS

For a detailed description of the disclosed embodiments, reference will now be made to the accompanying drawings in which.

DETAILED DESCRIPTION

Figure 1:
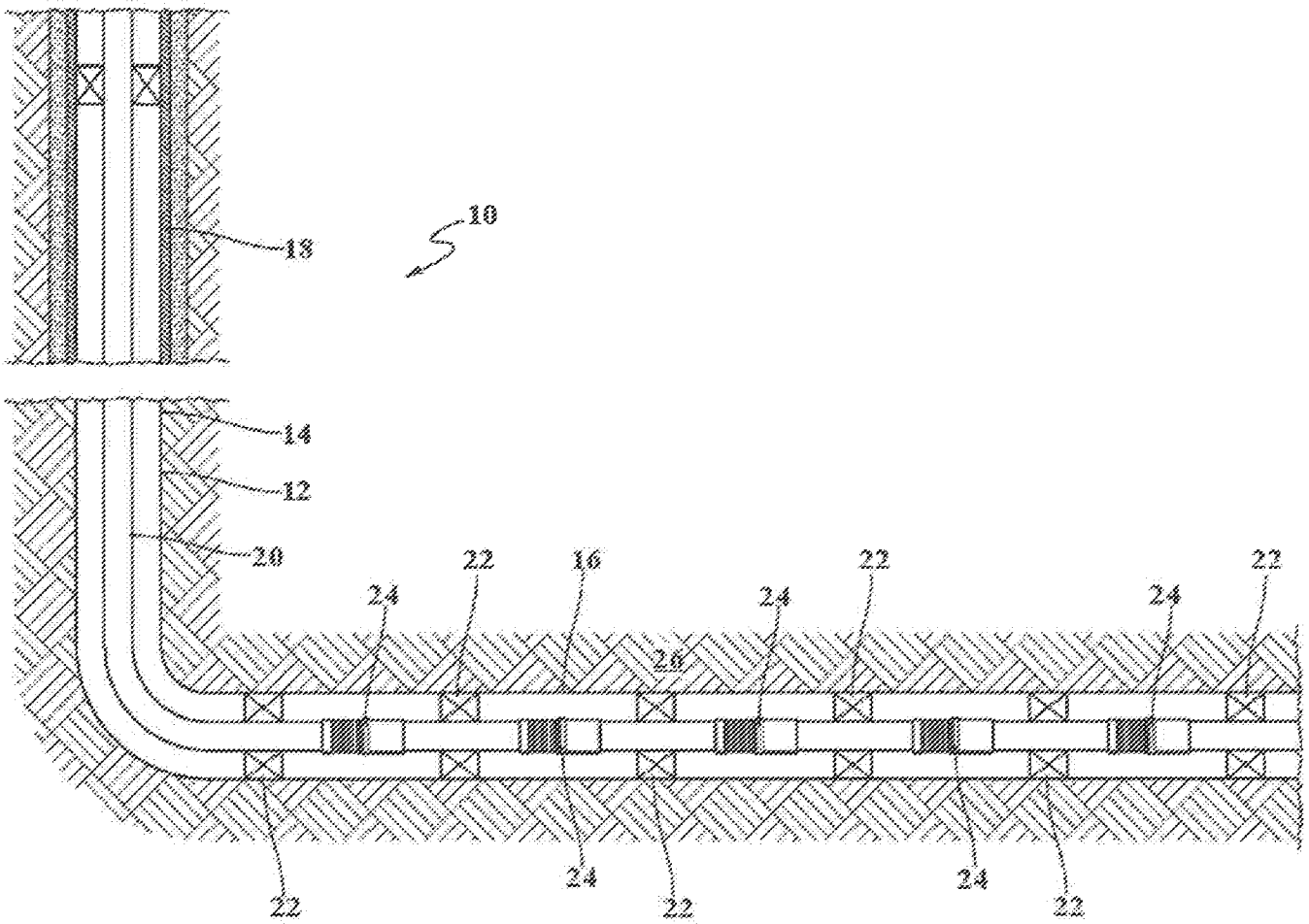
FIG. 1 is a schematic illustration of a well system including a plurality of flow control devices according to an embodiment.

It should be understood at the outset that although illustrative implementations of one or more embodiments are disclosed herein, the disclosed apparatus, systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Certain terms are used throughout the following description and claims to refer to particular features or components. The drawings are not necessarily to scale. Certain features and components herein may be shown exaggerated in scale or in somewhat schematic form and some details of conventional elements may not be shown in interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "uphole" meaning toward the surface of the wellbore and with "down," "lower," "downward," or "downhole" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

The present disclosure describes an apparatus and method for quickly and efficiently bypassing a flow restriction (e.g., an ICD) after it has been installed downhole in a well and sealing off the well from the surrounding formation without the need for physically intervening into the well. While a number of bypass mechanisms may be used with the apparatus and method described herein, it will be appreciated that the flow control device may be used to close off a first flow path through the flow restriction in response to a first pressure, and at the same time or thereafter open a second flow path in response to a second pressure. While the first pressure can be greater than, less than, or equal to the second pressure, having the first pressure be less than the second pressure may allow for the first flow path to be closed off and then the second flow path to be opened at a later time. A plurality of flow control devices may be used in a production string to close off a plurality of flow restrictions in response to the first pressure, and then open a plurality of bypass flow paths in response to the second pressure. Thus, multiple flow paths may be changed in response to one or more pressures, which may represent an advantage over the use of flow restrictions alone. Further, multiple flow paths may be changed using pressure alone without physically intervening in the well, which may represent an advantage over previous systems requiring the use of setting tools conveyed within the wellbore.

Referring initially to FIG. 1, therein is depicted an exemplary well system 10 comprising a wellbore 12 with both a substantially vertical section 14 and a substantially horizontal section 16, casing 18, tubular string 20, a plurality of spaced apart packers 22 and flow control devices 24, and a formation 26.

Production of hydrocarbons may be accomplished by flowing fluid containing hydrocarbons from the formation 26, through the uncased and open horizontal wellbore 16 and into the tubular string 20 through the plurality of flow control devices 24. In this example, the flow control devices 24 provide for the filtering of unwanted material from the formation 26 and for the metering of fluid input from the formation into the tubular string 20. Packers 22 isolate each individual flow control device 24 into different zones or intervals along the wellbore 12 by providing a seal between the outer wall of the wellbore 12 and tubular string 20.

Frictional effects of the fluid flow through the tubular string 20 may result in increased fluid pressure loss in the uphole section of the tubular string 20 relative to the downhole section of the tubular string 20 disposed in the horizontal wellbore 16. This pressure loss results in an increased pressure differential between the uphole sections of the tubular string 20 disposed in the horizontal section 16 and the formation 26, which in turn results in a higher flow rate into the uphole section of the tubular string 20. Thus, isolating each fluid control device 24 allows for the tailoring of the metering capability of each fluid control device 24 to result in a more even flow rate into each section of the tubular string 20. For instance, the uphole flow control devices 24 could include larger flow restrictions to act against the larger differential pressure forcing fluid into the flow control devices.

Although FIG. 1 depicts the flow control devices 24 in an open and uncased horizontal wellbore 16, it is to be understood that the flow control devices are equally suited for use in cased wellbores. For instance, the flow control devices 24 and packers 22 may be used for flow control purposes when injecting chemicals, such as acids, and/or perforating the casing for the later production of hydrocarbons. Further, although FIG. 1 depicts single flow control devices 24 as being isolated by the packers 22, it is to be understood that any number of flow control devices 24 may be grouped together and isolated by the packers 22, without departing from the principles of the present disclosure. In addition, even though FIG. 1 depicts the flow control devices 24 in a horizontal wellbore 16, it is also to be understood that the flow control devices are equally suited for use in wellbores having other directional configurations including vertical wellbores, deviated wellbores, slanted wellbores, multilateral wellbores and the like.

An embodiment of a flow control device may comprise a control chamber having a piston therein that is moveable from an open piston position to a closed position by the application of a first fluid pressure and a valve chamber having a valve therein that is moveable from a closed valve position to an open valve position by the application of a second fluid pressure. Also, a seal preventing fluid flow through the control chamber into the tubular member is formed in the closed piston position and a flow path through the valve chamber and into the tubular member may be formed in the open valve position. The flow control device may further comprise a restraining member disposed adjacent to the piston, wherein the restraining member is actuated by movement of the piston in response to the first fluid pressure. The flow control device may also comprise a restraining member disposed adjacent to the valve, wherein the restraining member is actuated by movement of the valve in response to the second fluid pressure. The fluid flow through the control chamber into the tubular member may create a first pressure drop while the fluid flow through the valve chamber into the tubular member may create a second pressure drop, which may be a pressure drop that is greater than, less than, or equal to the first pressure drop. Also, the first fluid pressure may be greater, smaller, or substantially equal to the second fluid pressure.

Figure 2:
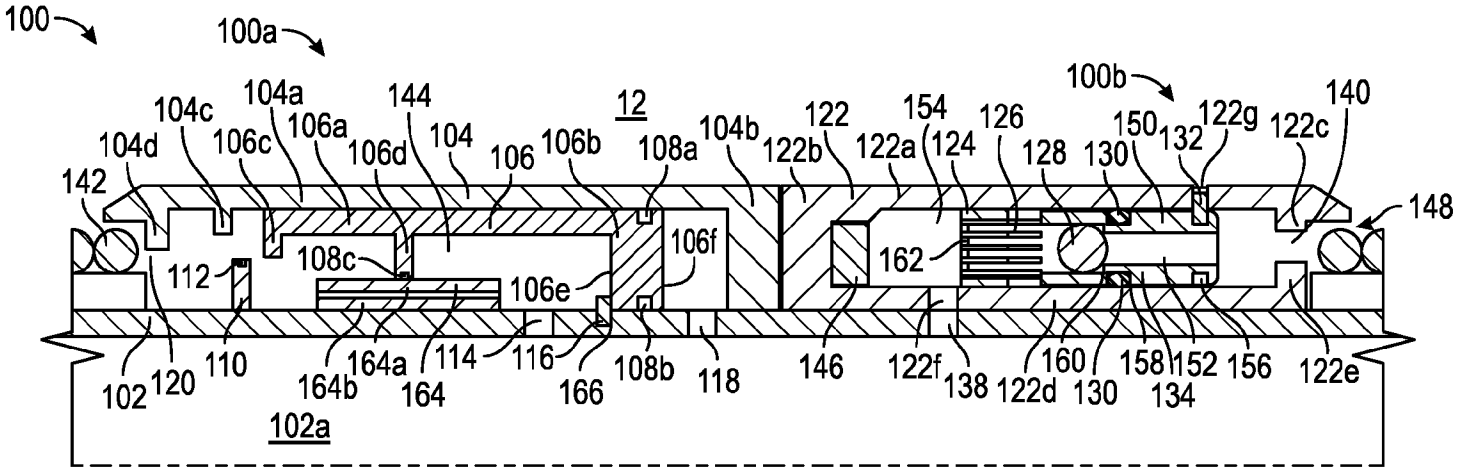
FIG. 2 is a cross-sectional view of an embodiment of a flow control device.

Referring now to FIG. 2, therein is depicted a cross-sectional view of an embodiment of a flow control device 100 suitable for use as flow control device 24 previously described with reference to FIG. 1. Flow control device 100 generally includes a flow restrictor portion 100*a* and a bypass valve portion 100*b*. Flow restrictor portion 100*a* generally includes a pipe or tubular member 102, a filter 142, a first port 114, a housing 104, a flow restrictor member 164, a piston 106, a flange 110, a second port 120, a shear member 116, and a third port 118.

Pipe 102 is any tubular member capable of being used downhole and communicating fluid at high pressures. Pipe 102 includes an internal fluid passageway 102*a*, through which fluids may be conveyed in both uphole and downhole directions, and radially directed first port 114 and third port 118 that extend through the wall of the tubular pipe 102.

Housing 104 is an annular member disposed about the pipe 102 and includes a cylindrical outer wall 104*a*, a retaining flanged portion 104*c* extending radially therefrom, and a fixed flanged portion 104*b* extending radially from the cylindrical outer wall 104*a* and fixed to the outer surface of the pipe 102. Together, the outer wall 104*a* and the flange 104*b* define a first chamber 144 between the housing 104 and the pipe 102. Third port 118 provides for fluid communication between the internal fluid passageway 102*a* and the portion of the first chamber 144 defined by a second side 106*f* of piston 106, cylindrical outer wall 104*a*, and the fixed flanged portion 104*b* of the housing 104. Opposite fixed flanged portion 104*b* and adjacent to filter 142 is internal flange 104*d* that extends radially into the first chamber 144 from outer wall 104*a* and, as described in more detail below, defines a portion of the second port 120.

In the embodiment shown in FIG. 2, flow restrictor 164 is an annular member that is disposed about the pipe 102. In this embodiment, restrictor 164 has an elongate cylindrical portion 164*a* fixed to the pipe 102. Flow restrictor 164 also includes at least one through passage 164*b* extending in an axial direction through tubular portion 164*a*.

Flange 110 is an elongated member extending radially outward from the pipe 102. Flange 110 is fixed to the pipe 102 and includes an outwardly facing seal 112.

Piston 106 is an annular member disposed about the pipe 102 and adapted for sliding engagement relative to the housing 104 and the pipe 102. Piston 106 is configured similarly to the housing 104, and includes an elongated outer wall 106*a*, a lower flanged portion 106*b*, a sealing flanged portion 106*d* and an upper flanged portion 106*c* opposite the lower flanged portion. The lower flanged portion 106*b* extends inwardly from the outer wall 106*a* and retains the annular seals 108*a* and 108*b*, which sealingly engage the inner surface of the housing 104 and the outer surface of the pipe 102, respectively. The lower flanged portion 106*b* also includes a first side 106*e* disposed adjacent to the shear member 116 and a second side 106*f* disposed adjacent to the third port 118. The sealing flanged portion 106*d* includes a seal 108*c* for a sealing engagement with the outer surface of the cylindrical portion 164*a* of the flow restrictor 164. The upper flanged portion 114*c* includes an inwardly facing sealing surface for sealingly engagement with the seal 112 retained in the flange 110. The piston seals 108*a* and 108*c* divide the first chamber 144 into two portions, with one portion containing the first port 114, flange 110, flow restrictor 164, second port 120, sealing flange 106*d*, shear member 116, and the other portion containing the third port 118.

The shear member 116 is a frangible pin disposed in a slot 166 or other such recess in the wall of pipe 102 in first chamber 144. Also, the shear member 116 is disposed so as to engage the first side 106*e* of the piston 106. The longitudinal axis of the shear member 116 is perpendicular to the longitudinal axis of the pipe 102. In an embodiment, a plurality of shear members may be used about pipe 102 to produce a desired retaining force.

Referring still to FIG. 2, bypass valve portion 100*b* generally includes the pipe or tubular member 102, a filter 148, a housing 122, a magnet 146, a valve 150, a shear flange 132, a fourth port 140 and a fifth port 138. Bypass valve portion 100*b* and pipe 102 include a radially directed fifth port 138 that extends through the tubular wall of the pipe 102.

Housing 122 is an annular member disposed about the pipe 102 and includes a cylindrical outer wall 122*a*, a cylindrical inner wall 122*d*, an interior flanged portion 122*b* extending radially from the cylindrical outer wall 122*a* to the cylindrical inner wall 122*d*, with the cylindrical inner wall 122*d* fixed to the outer surface of the pipe 102. Together, the outer wall 122*a*, the interior flanged portion 122*b* and the inner wall 122*d* define a second chamber 154. The cylindrical outer wall 122*a* includes a slot 122*g* for the insertion of the shear flange 132. A bore 122*f* extends radially through the inner wall 122*d* to provide for a passage to the fifth port 138, which provides for fluid communication between the internal fluid passageway 102*a* and the second chamber 154. Opposite the interior flanged portion 122*b* are outer flanged portion 122*c* and inner flanged portion 122*e*, both extending radially into the second chamber 154 and, as described in more detail below, define a portion of the fourth port 140.

In an embodiment, the valve portion may comprise a magnet 146. Magnet 146 may be cylindrical in shape in the embodiment shown and capable of producing a magnetic field that produces a force on ferromagnetic materials. Magnet 146 is fixed to the interior flanged portion 122*b* and extends substantially from the inner surface of the cylindrical outer wall 122*a* to the outer surface of the cylindrical inner wall 122*d*. Also, magnet 146 has a longitudinal axis that is parallel to the longitudinal axis of the pipe 102.

Valve 150 generally includes a valve body 134, an internal throughbore 152, O-ring seal 130, annular slot 156, valve plug 128, collet fingers 126, and retaining ring 124. The valve body 134 is a generally cylindrical member and is slidingly engageable with the cylindrical outer wall 122*a* and cylindrical inner wall 122*d* of the housing 122. The valve body 134 includes a central throughbore 152 that extends along the longitudinal axis of the valve body. The valve body 134 also includes an annular slot 156 that extends circumferentially about the outer surface of the valve body 134. An annular groove 158 is also disposed circumferentially about the outer surface of the valve body 134, where it houses the O-ring seal 130. O-ring seal 130 seals between the cylindrical outer 122*a* and inner 122*d* surfaces of the housing 122 with the outer surface of the valve body 134.

Figure 4:
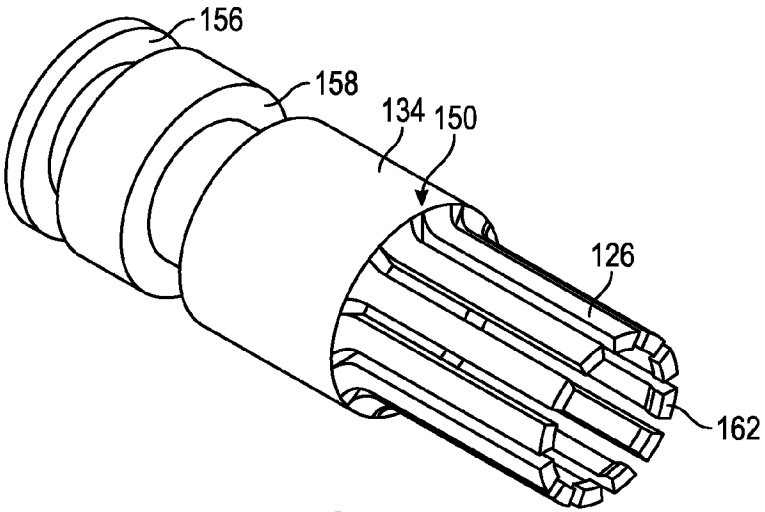
FIG. 4 is an isometric view of an embodiment of a valve body and collet assembly.

Now referring to FIGS. 2 and 4, fixed to the valve body 134 are a plurality of collet fingers 126, which extend axially towards the interior flanged portion 122*b* of the housing 122, and terminate at inwardly facing lip 162. Lip 162 of the collet fingers 126 is compressed radially inwardly by the retaining ring 124. The fingers 126 are manufactured to be biased to bend outwardly but are restrained by the retaining ring 124 to maintain a uniform internal diameter along their length up until lip 162. The cylindrical retaining ring 124 is fixed to the cylindrical outer 122*a* and inner 122*d* portions of the housing 122 and thus may not move along the longitudinal axis of the housing 122. However, the collet fingers 126 slidingly engage the inner cylindrical surface of the retaining ring 124.

Disposed within the central throughbore 152 is the valve plug 128. Even though the plug 128 is depicted as spherical in shape, valve plugs 128 could have alternate shapes including cylindrical configurations, substantially cylindrical configurations or other configurations so long as the plug 128 is capable of creating a seal within the valve body 134 and of being ejected from the valve body 134, as is described below. Additional details concerning these additional valve plug designs are disclosed in U.S. Patent Publication No. 2011/0253391, the entire disclosure of which is incorporated herein by this reference. Plug 128 is permitted to move axially through a portion of the central throughbore 152 but is restrained from complete axial freedom by a shoulder 160 and the lip 162 of the collet fingers 126. Shoulder 160 and lip 162 reduce the diameter of the internal throughbore 152 to a smaller diameter than that of the valve plug 128. The plug 128, having a larger diameter than the shoulder 160, may seal against the shoulder 160 to prevent a fluid flow from the fifth port 138 to the fourth port 140. Moreover, because the diameter of the plurality of collet fingers 126 at lip 162 is smaller than the diameter of the plug 128, contact between the plug 128 and the lip 162 forms a seal preventing or substantially restricting a fluid flow from the fourth port 140 to the fifth port 138.

Shear flange 132 is disposed in the slot 122*g* of the cylindrical outer wall 122*a* of the housing 122. Shear flange 132 is an elongate member with a longitudinal axis perpendicular to the longitudinal axis of the pipe 102 and extends from the slot 122*g* to the annular slot 156 of the valve body 134.

Figure 3A:
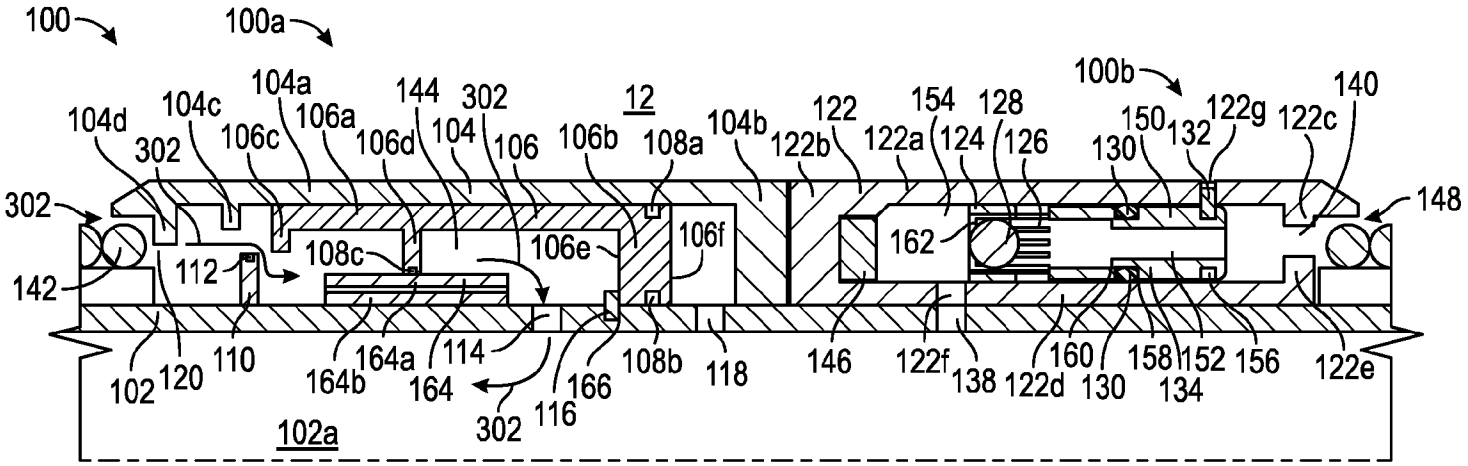
FIG. 3A is a cross-sectional view of an embodiment of the flow control device shown in a first configuration.

An exemplary operation of the flow control device 100 of FIG. 2 is best understood with reference to FIGS. 3A-3D. Referring first to FIG. 3A, during normal operation when producing hydrocarbons via a well system, the pressure within pipe 102 will be lower than the pressure of fluid within a surrounding formation. At this time, the piston 106 is disposed in a first position where the first side 106*e* acts on the shear member 116 and the seal 108*c* of the sealing flange 106*d* is sealingly engaged with the outer surface of the flow restrictor 164. In this first configuration of the flow control device 100, due to the external differential pressure, a flow path 302 is established where fluid within the wellbore 12 enters the filter 142 of the flow restrictor portion 100*a* of the flow control device 100 in order to remove any entrained sand or other debris and particulates. The filter 142 illustrated in FIG. 3A is a type known as "wire-wrapped," where wire is closely wrapped helically about pipe 102, with the spacing between each windings of wire designed to allow the passing of fluid but not of sand or other debris above a certain size. Other types of filters may also be used, such as sintered, mesh, pre-packed, expandable, slotted, perforated and the like.

Following filtration, fluid enters the flow control device 100 through the first port 120 and then through an existing gap between the flange 110 and the flanged portion 106*c* of the piston 106. Next, the flow path 302 is directed through the internal flow passage 164*b* of the flow restrictor 164. The flow path 302 cannot circulate around the flow restrictor 164 due to the sealing engagement between the seal 108*c* of the sealing flanged portion 106*d* and the outer surface of the cylindrical portion 164*a* of the flow restrictor 164. Upon exiting the flow restrictor 164, the flow path 302 enters the first port 114 and then into the internal fluid passageway 102*a*.

While the external differential pressure between the fluid within the wellbore 12 and the fluid within the internal passageway 102*a* also acts on the bypass valve portion 100*b* of the flow control device 100, the flow path between the fourth port 140 and the fifth port 138 may be substantially blocked due to the configuration of the valve 150. Fluid from the wellbore 12 is conveyed through the filter 148, into the second chamber 154, and enters the internal throughbore 152. Fluid from the wellbore 12 may not bypass the valve body 134 due to the sealing engagement between the seal 130 in the annular groove 158 and the housing 122 and the external surface of the pipe 102. Further, fluid entering the internal throughbore 152 may not flow through the fifth port 138 due to the sealing engagement between the valve plug 128 and the lip 162 of the collet fingers 126. Thus, the only flow path established in this first configuration of the flow control device 100 is the flow path 302, in which fluid enters the flow restrictor portion 100*a* from the second port 120, flows through the flow restrictor 164, and enters the internal passageway 102*a* of the pipe 102 through the first port 114.

Referring again to FIG. 1, while producing from the well, it may become advantageous to stop production and shut in the well system 10 by sealing the tubular string 20 off from the fluid within the formation 26 in order, for example, to service or perform maintenance on the well system 10. Further, it also may be advantageous at a certain point in the production process to seal off particular intervals in the production string 20 by individually sealing particular specific flow control devices 24. For instance, certain portions of the horizontal section 16 of the wellbore 12 may contain high permeability zones, resulting in faster and more severe water coning in these zones compared to lower permeability zones. Thus, it is sometimes advantageous to only seal off the flow control devices 24 in high permeability zones, in order to delay the event of water production from the formation 26 to the tubular string 20.

Figure 3B:
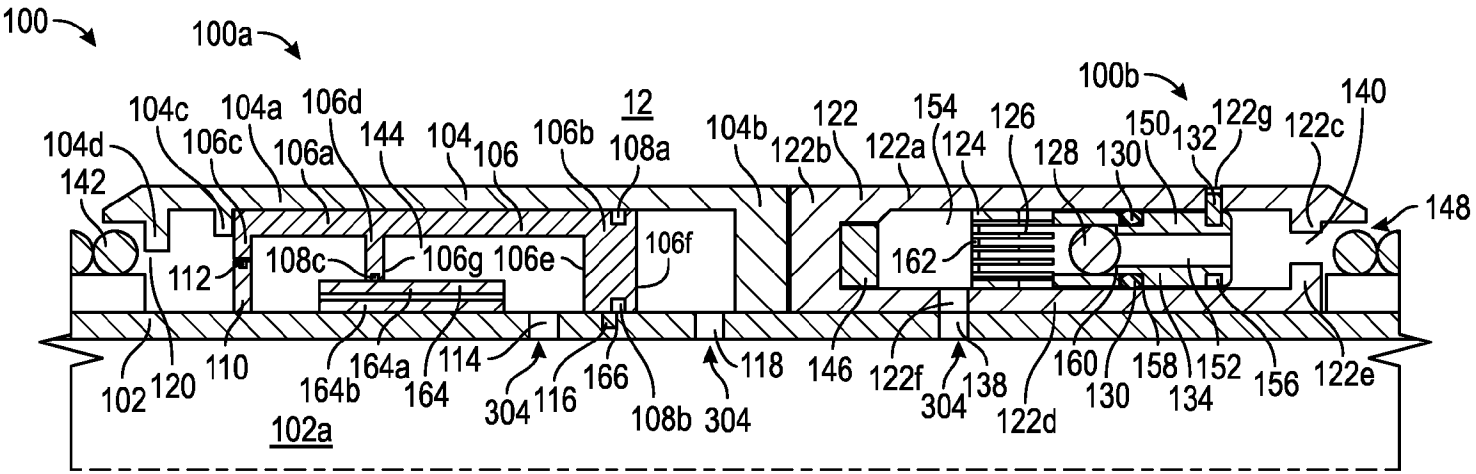
FIG. 3B is a cross-sectional view of an embodiment of the flow control device of FIG. 3A shown in a second configuration.

Referring now to FIG. 3B, in order to seal the internal passageway 102*a* of the pipe 102 from the surrounding wellbore 12, the flow control device 100 is reconfigured by creating an internal pressure differential, wherein the pressure within the internal passageway 102*a* is higher than the fluid pressure within the wellbore 12. This internal pressure differential may be created by a first pressure signal that pressurizes the internal passageway 102*a* through the pumping of fluid from the surface of the well system 10, as illustrated in FIG. 1, downhole into the tubular string 20.

Once the internal pressure differential is created by pressurizing of the internal passageway 102*a*, a flow path 304 is established. Flow path 304 allows fluid to flow from the pressurized internal passageway 102*a* into the radially disposed first port 114 and third port 118 of the flow restrictor portion 100*a* and the fifth port 138 of the bypass valve portion 100*b*. As the flow path 304 enters the third port 118 and the first port 114 of the flow restrictor portion 100*a*, the high pressure of the fluid within the flow path 304 produces a pressure force on the piston 106. The high pressure of the fluid in flow path 304 acts on the first side 106*e*, second side 106*f*, and third side 106*g* of the piston 106. The second side 106*f* and third side 106*g* both face in the direction away from the second port 120 and thus pressure acting on these two faces produces a pressure force on the piston 106 in the direction of the second port 120. The total force on the piston 106 produced by the pressure acting on the second side 106*f* and the third side 106*g* is proportionate to the surface areas of the second side 106*f* and third side 106*g*. The high pressure produced by the fluid in the flow path 304 also acts on the first side 106*e* of the piston 106, and since the first side faces towards the second port 120, pressure acting on the first side 106*e* produces a pressure force on the piston 106 in the direction away from the second port 120.

A net force on the piston 106 is produced by the summation of the pressure forces acting on the first side 106*e*, second side 106*f*, and third side 106*g*. Thus, given that the net force on the piston 106 produced by the pressure of the fluid within the flow path 304 acts in the direction of the second port 120, the piston 106 is forcibly compelled in the direction of the second port 120, and thus acts on and transfers a force to the shear member 116.

The shear member 116 is frangibly fixed to the radial slot 166 of the pipe 102 and is designed to shear upon the application of a predetermined force by the piston 106 acting on the shear member 116. The force application necessary to shear the member 116 is predetermined and thus, given the known relationship between the net force acting on the piston 106 and the pressure delivered by the fluid within the flow path 304, an operator of a well system may apply a predetermined first pressure to the internal passageway 102*a* of the pipe 102 to create a predetermined internal differential pressure, such that the net force acting on the piston 106 will in turn produce a force on the shear member 116 large enough to shear the member 116, allowing the piston to move axially towards the second port 120, compelled by the pressure force from the flow path 304.

Upon axial movement of the piston 106 in the direction of the second port 120, the upper flanged portion 106*c* of the piston 106 eventually impacts the retaining flanged portion 104*c* of the housing 104, preventing the piston from any further axial movement in the direction of the second port 120. As the upper flanged portion 106*c* makes contact with the retaining flanged portion 104*c*, a seal is formed between the upper flanged portion 106*c* of the piston 106 and the seal 112 of the flange 110 fixed to the pipe 102. This sealing engagement prevents any fluid within the flow path 304 from further escaping from the flow control device 100 into the wellbore 12 through the second port 120, thus sealing the flow restrictor portion 100*a* of the flow control device 100.

Regarding the bypass valve portion 100*b* of the flow control device 100, high pressure fluid from the internal passageway 102*a* flows into the fifth port 138 and into the second chamber 154. Further, the fluid within the flow path 304 enters the internal throughbore 152 of the valve 150. High pressure from fluid within the flow path 304 then acts against the valve plug 128, compelling the plug 128 to move axially in the direction of the fourth port 140. As the plug 128 moves axially within the internal throughbore 152, it contacts shoulder 160 of the valve body 134. This contact forms a seal, preventing fluid in the flow path 304 from continuing through the throughbore 152 and out of the fourth port 140. Further, fluid within the flow path 304 may not divert around the valve body 134 due to the sealing engagement of the seal 130 with the housing 122. Thus, in this second configuration, the bypass valve portion 100*b* of the flow control device 100 seals the fluid within the internal passageway 102*a* from the external wellbore 12.

Once the second configuration of the flow control device 100 has been established, wherein the flow restrictor portion 100*a* and the bypass valve portion 100*b* have both sealed the internal passageway 102*a* from the external wellbore 12, pressure within the internal passageway 102*a* may be reduced in order to perform work within the well, abandon the well, or for other purposes, and the passageway 102*a* will remain sealed.

Referring again to FIG. 1, now that at least some intervals in the well system 10 have been shut in by sealing at least some intervals in the tubular string 20 from the formation 26, it may be advantageous to reopen the sealed flow control devices 24 for further production into the tubular string 20. Further, it may be advantageous to reduce the flow restriction through the flow control devices 24 in order to increase the flow rate entering the tubular string 20 from the formation 26.

For instance, a uniform flow rate for each individual flow control device 24 is often initially desired in order to delay water or gas production into the tubular string 20 from the formation 26. Once a well system 10 has begun producing water or gas from the formation 26, the advantage of a uniform metered flow from flow control devices 24 is diminished, and instead, increased flow rates are desired in order to capture any remaining hydrocarbons left in the formation 26. Thus, a means for reducing flow restrictions within the flow control devices 24 then becomes desirable in order to increase the flow rate entering the tubular string 20 from the formation 26.

Figure 3C:
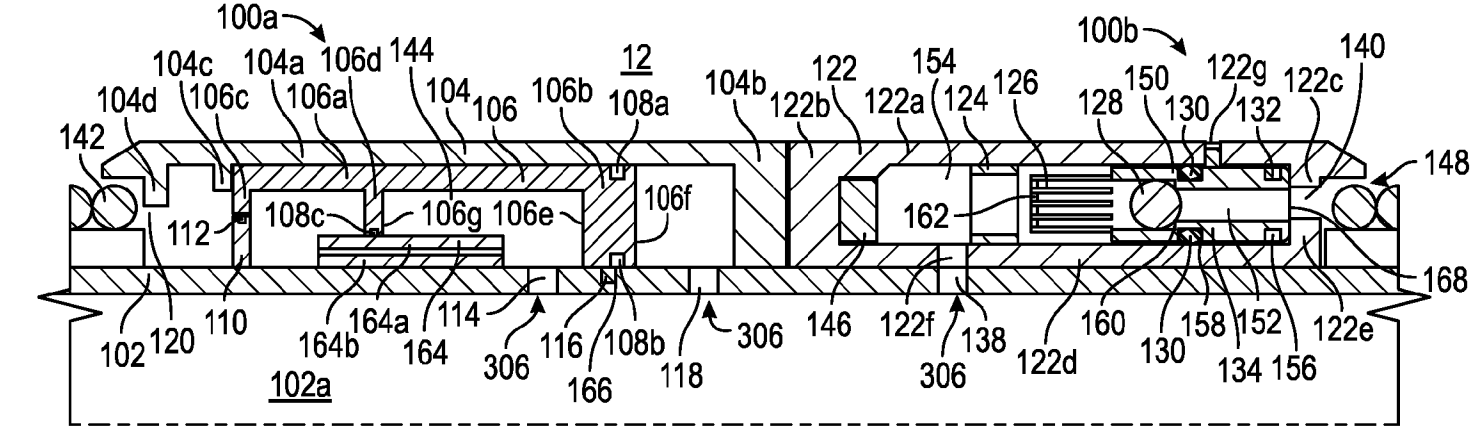
FIG. 3C is a cross-sectional view of an embodiment of the flow control device shown in a third configuration.

In order to open the flow control devices 24, devices 24 may be actuated into a third configuration, as illustrated by FIG. 3C. To position the flow control device 100 into a third configuration, a second internal pressure differential is created through the application of a second pressure signal to the internal passageway 102*a*. This second internal differential pressure, wherein the pressure within the passageway 102*a* is higher than the pressure of the fluid within the annular region between the housing 104 and the wellbore 12, may be established in a similar manner as the creation of the first internal pressure differential, for example, by flowing pressurized fluid from the surface of the well system of FIG. 1 downhole into the tubular string 20.

Referring again to FIG. 3C, the second internal pressure differential creates the fluid flow path 306, in which fluid enters the first port 114 and third port 118. Regarding the flow restrictor portion 100*a*, the fluid in flow path 306 is not allowed to exit the second port 120 due to the sealing engagement between the upper flanged portion 106*c* of the piston 106 and the seal 112 of the flange 110. While the pressure of the fluid within the flow path 306 may act on the piston 106, because the pressure force acting on the second side 106*f* and third side 106*g* is larger than the pressure force acting on the first side 106*e*, due to the larger combined surface area of the second side 106*f* and the third side 106*g*, the net force exerted on the piston 106 compels the piston 106 in the direction of the second port 120, and thus the piston upper flange 106*c* remains in a sealing engagement with the seal 112.

Regarding the bypass valve portion 100*b*, fluid flow in flow path 306 created by the second differential pressure enters the fifth port 138 and produces a pressure force on the portion of the surface of the valve plug 128 facing the interior flanged portion 122*b* of the housing 122. The pressure force applied to the valve plug 128 is transferred to the valve body 134 due to the sealing engagement between the plug 128 and the shoulder 160 of the valve body 134. Further, the fluid in flow path 306 may not be directed around the valve body 134 due to the sealing engagement of the seal 130 and the housing 122.

The pressure force exerted on the surface of the plug 128 that is transferred to the valve body 134 is further conveyed from the valve body 134 to the shear flange 132 disposed partially in the slot 122*g* of the housing 122 and the annular slot 156. The shear flange 132 is designed to shear when a predetermined force is applied to its external surface. Given that the amount of force applied to the shear flange 132 is a function, at least in part, of the pressure applied within the internal passageway 102*a* and the diameter of the valve plug 128, an operator of a well system, such as the well system 10 illustrated in FIG. 1, can apply a predetermined pressure to the internal passageway 10 to shear the shear flange 132 in order to allow for axial movement by the valve body 134 of the valve 150.

Further, the shear flange 132 may be designed to withstand a higher pressure within internal passageway 102*a* without shearing than the shear member 116 of the flow restrictor portion 100*a*. Thus, the application of the first internal pressure signal creates a large enough shearing force to shear the shear member 116 but not the shear flange 132, allowing for the first actuation of the piston 106 and then a second actuation of the valve body 134 of the valve 150.

The pressure force generated by the fluid within the flow path 306, having sheared the shear flange 132, continues to act against the outer surface of the valve plug 128, forcibly moving the valve body 134 axially towards the fourth port 140 into a second position. During the axial movement of the valve body 134, an outer face 168 of the valve body 134 impacts the outer flanged portion 122*c* of the housing 122, restraining the valve body 134 from further axial movement in the direction of the fourth port 140. Translating valve body 134 to the second position in which outer face 168 abuts outer flanged portion 122*c*, allowing the collet fingers 126 to axially slide free from the retaining ring 124. Now free from the retaining ring 124, the collet fingers 126 radially expand outward slightly, increasing the diameter of the internal throughbore 152 for the portion of the valve body 134 where the lips 162 are disposed. The increased diameter is now larger than the diameter of valve plug 128, allowing for the plug 128 to slidingly pass unobstructed through the opening defined by inwardly extending lips 162.

Figure 3D:
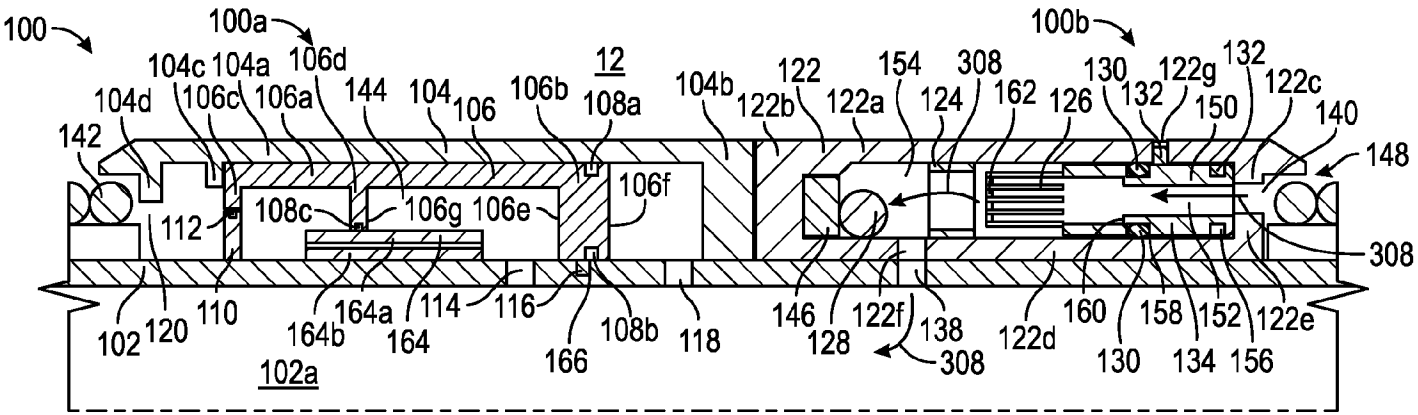
FIG. 3D is a cross-sectional view of an embodiment of the flow control device shown in a fourth configuration.

Although plug 128 may now slide axially through lip 162 due to the increased diameter of the opening defined by annular lip 162, the pressure force created by flow path 306 forcibly compels plug 128 against shoulder 160. Thus, in order to fully open valve 150, an external differential pressure is created to compel plug 128 in the direction of collet fingers 126, a process illustrated by FIG. 3D. Referring to FIG. 3D, flow path 308 is established by reducing the pressure within internal passageway 102*a*, such as by pumping out of tubular string 20 of FIG. 1 at the surface of well system 10. Having created a state where pressure of the fluid within wellbore 12 is higher than the pressure of fluid within internal passageway 102*a*, fluid along flow path 308 enters into the flow control device 100.

Regarding flow restrictor portion 100*a* of flow control device 100, fluid from wellbore 12 may enter through second port 120 but cannot pass the sealing engagement between upper flanged portion 106*c* of piston 106 and seal 112 of flange 110. Specifically, while fluid entering second port 120 will be of higher pressure than fluid within internal passageway 102*a*, fluid within passageway 102*a* may enter through first port 114 and third port 118, creating a pressure force acting on piston 106 in the axial direction of second port 120. This pressure force is larger than the pressure force acting on upper flanged portion 106*c* in the opposite direction because the pressure force has a larger surface area of the piston 106 to act upon, resulting in a larger force on the piston 106 in the direction of second port 120. Thus, a flow path cannot be established between second port 120 and first port 114.

Regarding bypass valve portion 100*b* of flow control device 100, the external pressure differential results in fluid flow along flow path 308 entering fourth port 140. Once passing through filter 148, fluid conveyed in flow path 308 enters internal throughbore 152 of valve 150. Pressure from fluid in flow path 308 acts on the surface of valve plug 128 facing fourth port 140, forcibly compelling plug 128 axially in the direction of magnet 146. Plug 128 slides axially past radially expanded lip 162 and retaining ring 124, coming to rest along the surface of magnet 146, which provides a magnetic force upon plug 128, locking it into a secured, resting position where it may not obstruct the flow along flow path 308. In an embodiment, the diameter of bore 122*f* and fifth port 138 may be of a size larger than valve plug 128, allowing the valve plug to pass through bore 122*f* and fifth port 138 and be ejected into the internal passageway 102*a* of pipe 102.

While FIG. 3D illustrates the use of magnet 146 as a mechanism for restraining the valve plug 128, another embodiment is to provide a bypass valve portion 100*b* such that bore 122*f* and fifth port 138 are larger in diameter than plug 128, allowing plug 128 to slide through bore 122*f* and port 138 so it can be expelled into internal passageway 102*a* and out of chamber 154.

In both arrangements, now unobstructed by valve plug 128, fluid along flow path 308 flows through retaining ring 124 and through fifth port 138 into the internal passageway 102*a* of pipe 102. Because bypass valve portion 100*b*, as illustrated in FIG. 3D, does not include a flow restrictor, a higher flow rate through bypass valve portion 100*b* may be established versus flow restrictor portion 100*a* when flow restrictor portion 100*a* is in its open state, as illustrated in FIG. 3A. However, a flow restrictor may be installed within chamber 154 of bypass valve portion 100*b*, allowing for the restriction of flow along flow path 308, similar to the restriction offered by flow restrictor member 164. This design may be beneficial where a well system operator wishes to have similar flow rates through flow restrictor portion 100*a* and bypass valve portion 100*b*, when they are each in their open configurations.

For instance, a well system operator may wish to use filter 148 as a redundant filter and to only flow through bypass valve portion 100*b* after filter 142 has clogged from extensive use. Thus, the operator may wish to maintain the same flow rate from the fluid within wellbore 12 into the internal passageway 102*a* of pipe 102, and will only switch from flow restrictor portion 100*a* to bypass valve portion 100*b* to take advantage of the redundant filtering capability offered by filter 148.

Furthermore, an alternative embodiment may comprise a flow control device where shear member 116 of flow restrictor portion 100*a* and shear flange 132 of bypass valve portion 100*b* are configured to both shear at the same pressure differential between internal passageway 102*a* and wellbore 12. Thus, in this embodiment the flow restrictor portion 100*a* and bypass valve portion 100*b* would actuate at the same time, allowing the flow control device 100 to move from a first flow path 302 (FIG. 3A), to flow path 304 (FIG. 3B) and then immediately to flow path 308 (FIG. 3D), skipping the shut in configuration, as illustrated in FIG. 3C. Also, in another embodiment, shear flange 132 may be configured to shear at a lower differential pressure between internal passageway 102*a* of pipe 102 and the wellbore 12 than shear member 116, resulting in the bypass valve portion 100*b* actuating first, at a lower differential pressure, and flow restrictor portion 100*a* actuating second at a higher differential pressure.

With reference to FIGS. 2-4, a shear flange 132 was described as a restraining mechanism or releasable latch that prevents axial movement of valve 150 towards the fourth port 140 until a pressurization of predetermined magnitude caused valve 150 to shear the shear flange 132, thereby freeing the valve to move axially by means of a pressure force acting on valve plug 128. Other releasable latches or restraining mechanisms can likewise be employed, including those that do not require the shearing of frangible members. For example, and referring now to FIG. 5A, another type of restraining mechanism is disclosed as employed in flow control device 500. More specifically, the restraining mechanism employed in flow control device 500 is a partial J-slot mechanism. In this embodiment, an annular housing 508 is disposed about pipe 102 and includes an inwardly extending flanged portion 508*b* extending radially from a cylindrical portion 508*a* and fixed to the pipe 102. Housing 508 also features an integral outer flanged portion 508*c* extending radially from cylindrical portion 508*a*. Inner flanged portion 508*b* and cylindrical portion 508*a* partially define chamber 542.

Disposed within chamber 542 is piston 510 featuring cylindrical portion 510*a*, inner flanged portion 510*b* and outer flanged portion 510*c*. A biasing member 520 is also disposed within chamber 542 and is biased to forcibly act against inner flanged portion 508*b* and a first face 538 of piston 510. A flange 514 with an accompanying seal 516 is fixed against the outer surface of pipe 102, with seal 516 provides for sealing engagement with the outer flanged portion 510*c* of piston 510. An annular groove is also disposed in the cylindrical portion 510*a*, where it houses one or more O-ring seals 512*a*, 512*b*. O-ring seals 512*a*, 512*b* seal between the piston 510 and inner surfaces of the housing 508 with the outer surface of the wellbore tubular 102.

An irregularly shaped J-Slot 522 is disposed within a top surface 536 of piston 510. A ring 524 is disposed within a slot in the cylindrical portion 508*a* of housing 508. Ring 524 is fixed axially by housing 508 but is free to rotate within housing 508 and about pipe 102. Fixed to ring 524 is a radially-extending lug 526, disposed within a portion of slot 522. Lug 526 restricts the degree of rotation afforded ring 524 due to contact between lug 526 and the outer wall of slot 522.

Figure 5A:
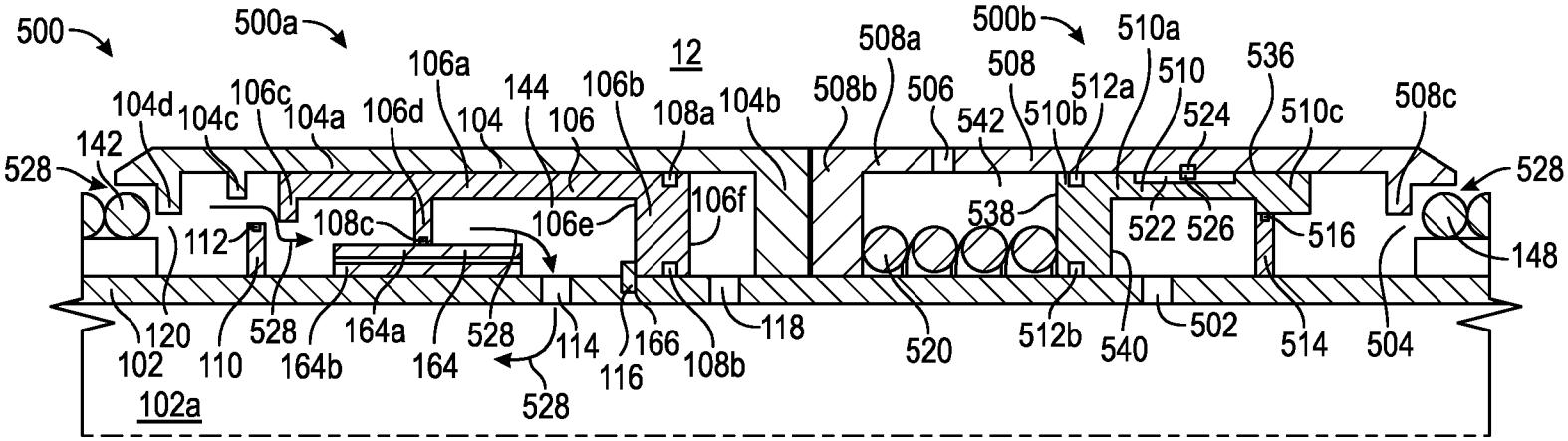
FIG. 5A is a cross-sectional view of an embodiment of a flow control device including a restraining member in the form of a J-Slot mechanism shown in a first configuration.
Figure 6:
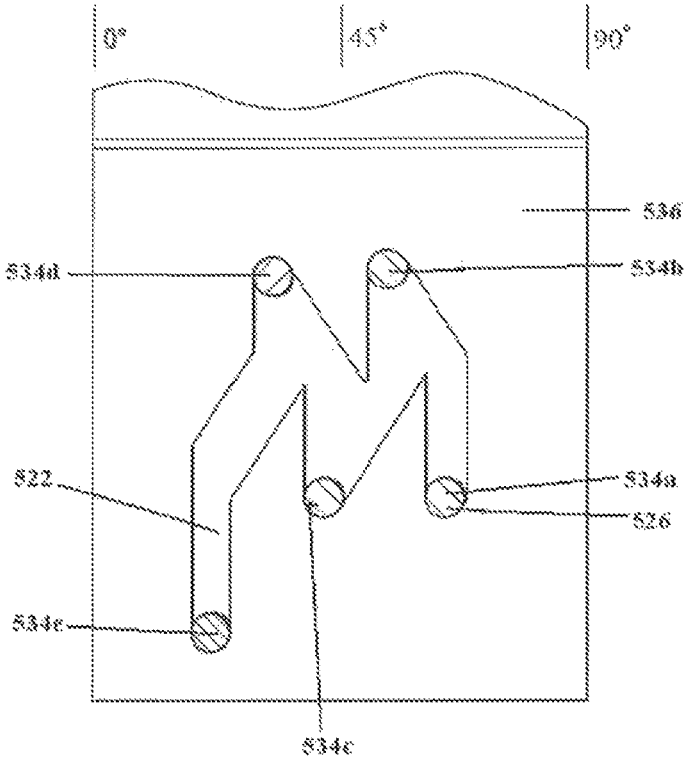
FIG. 6 is a top view of an embodiment of the J-Slot shown in FIGS. 5A-5D.
Figure 7:
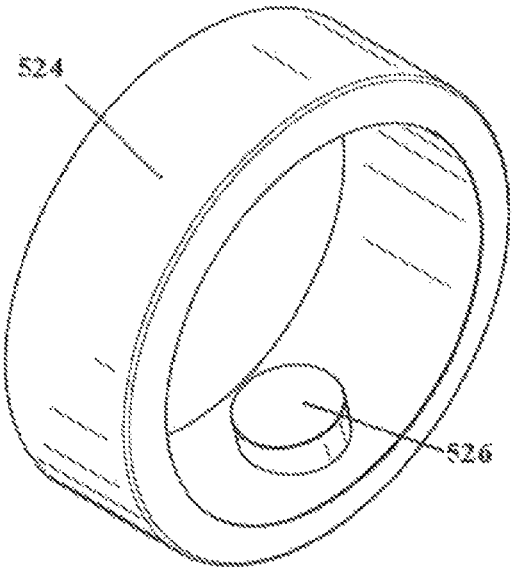
FIG. 7 is an isometric view of an embodiment of a lug ring for the J-Slot mechanism of FIGS. 5A-5D.

FIG. 6 illustrates the top surface 536 of piston 510. Disposed within top surface 536 is the irregularly shaped J-Slot 522, and within slot 522 is disposed lug 526. Lug 526, depending on the position of piston 510, may occupy four different positions in slot 522: first position 534*a*, second position 534*b*, third position 534*c*, fourth position 534*d* and fifth position 534*e*. FIG. 6 is shown oriented such that the top of FIG. 6 is axially proximal to the biasing member 520 (FIG. 5A) and the bottom of FIG. 6 is proximal to the outer flanged portion 510*c* (FIG. 5A). FIG. 7 illustrates the shape of ring 524 and lug 526, as they are configured in flow control device 500 of FIG. 5A.

Referring to FIG. 5A, flow control device 500 is shown in a production state where an external pressure differential results in flow path 528, wherein fluid from wellbore 12 enters flow control device 500 through second port 120, flows through flow restrictor 164, and into internal passageway 102*a* of pipe 102 through first port 114. Piston 510 occupies a first position where first face 538 of piston 510 is acted upon by biasing member 520. Biasing member 520 produces a force on piston 106 in the direction of fifth port 504. However, piston 510 is axially restrained from movement in the direction of fifth port 504 due to contact between lug 526 and slot 522. Referring to FIGS. 5A and 6, while piston 510 occupies this first position, lug 526 occupies first position 534*a* (FIG. 6), and is in contact with the outer wall of slot 522. Because lug 526 is fixed in the axial direction due to the disposition of ring 524 within a slot of housing cylindrical portion 508*a*, the action of lug 526 in first position 534*a* on the outer wall of slot 522 prevents piston 510 from axial movement in the direction of first port 114.

Piston 510 in the first position, restrained from further axial movement in the direction of fifth port 504, provides a sealing engagement between outer flanged portion 510*c* and seal 516 of flange 514. This sealing engagement prevents a fluid flow from fifth port 504 through chamber 542 and into internal passageway 102*a* of pipe 102 through fourth port 502. Thus, flow from wellbore 12 may only enter internal passageway 102*a* through flow restrictor portion 500*a*.

Figure 5B:
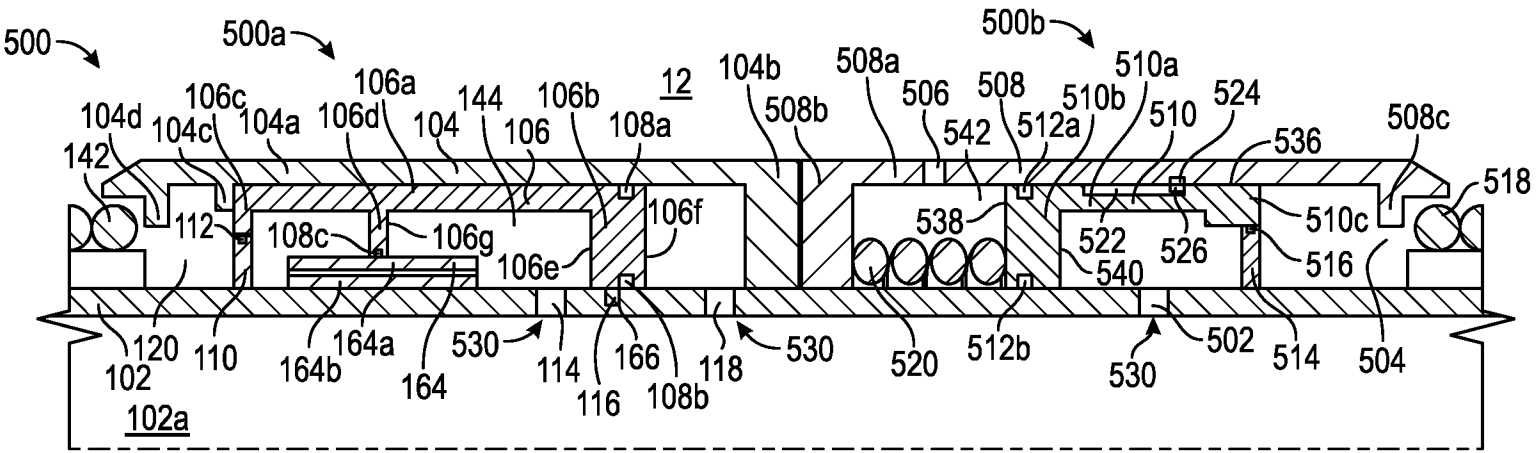
FIG. 5B is a cross-sectional view of an embodiment of the flow control device of FIG. 5A with the J-Slot mechanism shown in a second configuration.

Referring now to FIGS. 5B and 6, in order to seal the internal passageway 102*a* from wellbore 12, a well system operator pumps fluid at high pressure from the surface of the well system into internal passageway 102*a*, creating an internal differential pressure where the pressure within passageway 102*a* of pipe 102 is higher than the pressure of fluid within the wellbore 12 surrounding pipe 102. This internal pressure differential establishes flow path 530, where fluid enters flow restrictor portion 500*a* through first port 114 and third port 118, providing a pressure force on first side 106*e*, second side 106*f* and third side 106*g* of piston 106. This pressure force produces a net force on piston 106 in the direction of second port 120, with a predetermined magnitude so as to shear the shear member 116, providing for sealing engagement between upper flanged portion 106*c* and seal 112 of flange 110.

Further, this pressure force, providing a larger force than the directionally-opposed force produced by biasing member 520, actuates the J-Slot 702 mechanism. The pressure force may be predetermined, in that it may be calculated what pressure within internal passageway 102*a* is necessary to provide for a pressure force on the first face 540 of piston 510 to defeat the biasing force created by biasing member 520.

Now forcibly compelled in the axial direction of biasing member 520, opposite the direction of fifth port 504, piston 510 is free to axially slide in the direction of biasing member 520 until lug 526 reaches its second position 534*b*, shown by FIG. 6. After axial movement in the direction of biasing member 520 by piston 510, lug 526 comes into contact with the outer wall of slot 522 as it reaches second position 534*b*, restraining piston 510 from further axial movement in the direction of biasing member 520. In this second position, outer flanged portion 510*c* of piston 510 remains in sealing engagement with seal 516 of flange 514. Thus, flow restrictor portion 500*a* and bypass valve portion 500*b* both seal internal passageway 102*a* from wellbore 12.

Figure 5C:
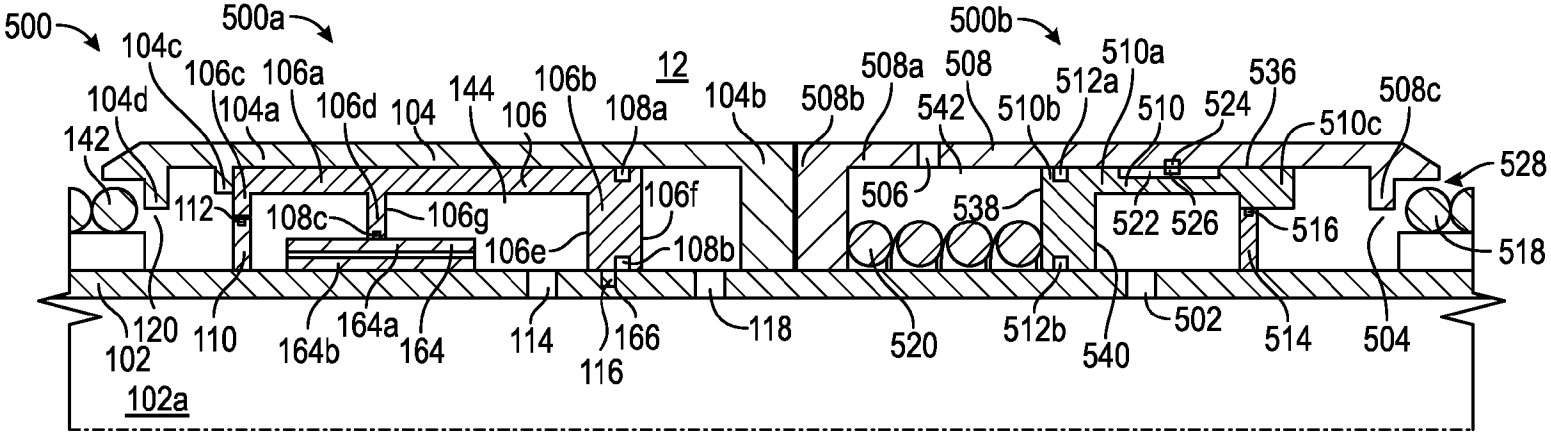
FIG. 5C is a cross-sectional view of an embodiment of the flow control device of FIG. 5A with the J-Slot mechanism shown in the third configuration.

Following the shearing of shear member 116 and the moving of piston 510 into its second position, a well system operator may reduce the pressure within internal passageway 102*a* by stopping any pumping into passageway 102*a*, in order to shut-in the well for abandonment purposes or to perform downhole work. Referring now to FIGS. 5C and 6, the reduction of pressure within internal passageway 102*a* eliminates or substantially decreases the internal pressure differential, allowing the biasing member 520 to overcome any present pressure forces on piston 510 and actuate the piston. The actuation of piston 510 returns it to its original position and positions lug 526 into a third position 534*c* (FIG. 6). Now in third position 534*c*, the lug 526 acting on the outer wall of slot 522 restrains piston 510 from further axial movement in the direction of fifth port 504, thus maintaining sealing engagement between outer flanged portion 510*c* and seal 516 of flange 514.

Referring again to FIGS. 5B and 6, in order to move piston 510 into a third position, a well system operator first creates a second internal pressure differential, such as illustrated in FIG. 5B. Regarding flow restrictor portion 500*a*, piston 106, having already been actuated by the first internal pressure differential, remains in its second position with upper flanged portion 106*c* sealing against seal 112 of flange 110.

Regarding bypass valve portion 500*b*, piston 510 is again actuated into its second position with the pressure force acting on second face 540 leading to a net force on piston 510 in the direction of biasing member 520. The movement of piston 510 into its second position actuates the J-Slot mechanism, moving lug 526 into its fourth position 534*d*, illustrated in FIG. 6. After actuation of piston 510, lug 526 comes into contact with the outer wall of slot 522 and thus comes to rest in its fourth position 534*d*, preventing any further axial movement by piston 510 in the direction of biasing member 520.

Figure 5D:
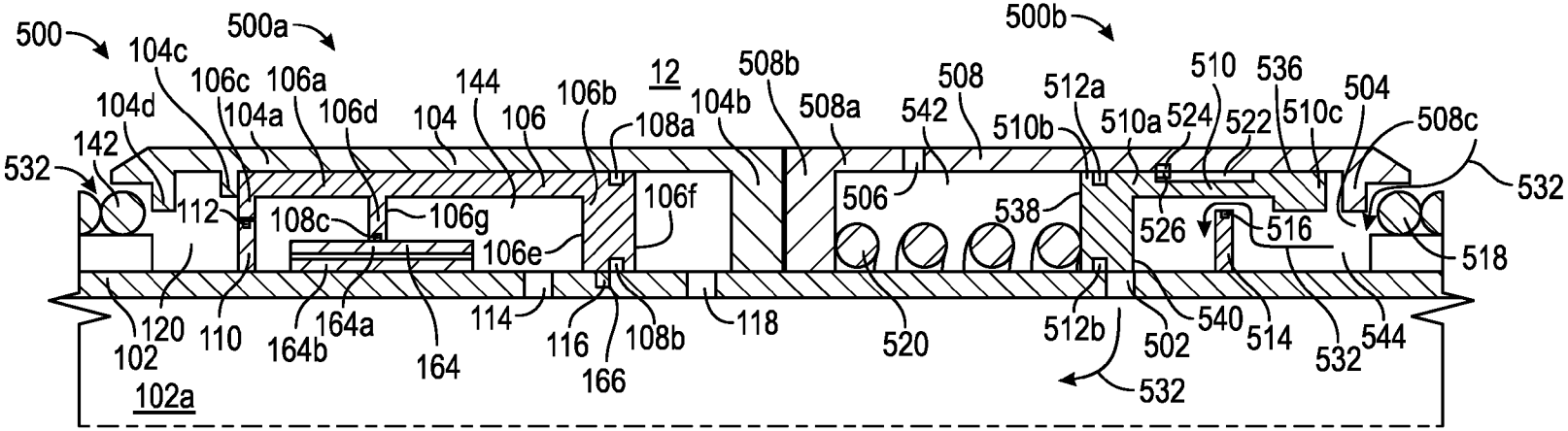
FIG. 5D is a cross-sectional view of an embodiment of the flow control device of FIG. 5A with the J-Slot mechanism shown in the fourth configuration.

Referring now to FIGS. 5D and 6, following the creation of the second internal differential pressure, a well system operator reduces pressure within internal passageway 102*a* of pipe 102, creating an external differential pressure where the fluid within wellbore 12 has a higher pressure than fluid within internal passageway 102*a*. The external differential pressure creates flow path 532, with fluid entering flow control device 500 through fifth port 504 and exiting into internal passageway 102*a* through fourth port 502. Also, the external differential pressure actuates J-Slot 522, moving piston 510 into a third position, illustrated in FIG. 5D.

While piston 510 is restrained from axial movement in the direction of biasing member 520 while lug 526 is in fourth position 534*d* (FIG. 6), piston 510 is free to slide axially in the direction of fifth port 504. The external pressure differential reduces the pressure force acting on second face 540 of piston 510, allowing the biasing member 520 to forcibly compel piston 510 in the direction of fifth port 504. Also, sixth port 506 allows for fluid communication between fluid within wellbore 12 and first face 538 of piston 510, thus equalizing any pressure forces acting on piston 510. With lug 526 in fourth position 534*d*, piston 510 slides axially in the direction of fifth port 504, positioning lug 526 in fifth position 534*e* (FIG. 6), wherein the outer wall of slot 522 prevents piston 510 from any further axial movement in the direction of fifth port 504.

Now in a third position, outer flanged portion 510*c* is no longer in sealing engagement with seal 516 of flange 514, resulting in a gap 544. Fluid along flow path 532 may thus flow through gap 544 and enter internal passageway 102*a* through fourth port 502. Also, flow path 532 does not flow through flow restrictor 164 of flow restrictor portion 500*a*, resulting in a second, smaller pressure drop of fluid in flow path 532 as it flows into internal passageway 102*a* from wellbore 12.

A method for controlling fluid flow into a pipe may comprise producing fluid through a flow restrictor disposed in a first flow path, substantially sealing the first flow path in response to a first pressure, establishing a second flow path in response to a second pressure, and producing fluid through the second flow path. Substantially sealing the first flow path may comprise applying a first pressure to the flow restrictor and to a piston that is disposed in a first position, causing the piston to move from the first position to a second position, the second position sealing fluid from flowing through the flow restrictor and into the pipe along the first flow path. Also, establishing a second flow path may comprise applying a second pressure greater than the first pressure to a valve that, when closed, prevents fluid flow into the pipe, the application of the second pressure causing the valve to open and allow fluid flow to pass through the valve into the pipe through a second flow path.

While specific embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. For instance, various designs of flow restrictors may be incorporated into the flow control device 100 illustrated in FIG. 2, such as orifice plates, helical tubes, U-Bend restrictors, nozzles, etc. Additional details concerning these additional flow restrictor designs are disclosed in U.S. Patent Publication No. 2009/0151925, the entire disclosure of which is incorporated herein by this reference. Accordingly, the scope of protection is not limited to the embodiments described herein, but is only limited by the claims that follow, the scope of which shall include all equivalents of the subject matter of the claims.

What is claimed is:

1. A flow control device comprising:

a tubular member having an interior passageway for conveying fluids;

a housing disposed about the tubular member and forming a chamber between the housing and the tubular member, wherein the housing is divided into a control chamber and a valve chamber;

a piston disposed within the control chamber and moveable between a first piston position and a second piston position that is displaced from the first piston position, wherein the piston divides the control chamber into first and second portions, and the piston is moveable between the first piston position and the second piston position by the application of pressure on at least one face of the piston in fluid communication with the interior passageway; and a valve disposed within the valve chamber and moveable between a first valve position and a second valve position that is displaced from the first valve position, wherein the valve provides for selective fluid communication between a first portion of the valve chamber and a second portion of the valve chamber, wherein the piston provides a first flow path between the control chamber and interior passageway of the tubular member in the first piston position, and wherein the valve provides a second flow path between the valve chamber and interior passageway of the tubular member in the second valve position.

2. The flow control device of claim 1, further comprising a valve retaining member, wherein the retaining member comprises a shear member that is configured to shear in response to a first pressure being applied to the valve.

3. The flow control device of claim 1, further comprising a valve retaining member, wherein the retaining member comprises a J-slot mechanism that is configured to actuate in response to a second pressure being applied to the valve.

4. The flow control device of claim 1, wherein the valve comprises a collet and valve plug assembly.

5. The flow control device of claim 1, wherein the valve comprises a piston and flange assembly.

6. The flow control device of claim 1, further comprising a flow restrictor disposed in the first portion of the control chamber, wherein fluid flow along the first flow path through the control chamber results in a pressure drop.

7. The flow control device of claim 1, wherein the valve provides for fluid communication between the first portion of the valve chamber and the second portion of the valve chamber when the valve is disposed in the second position.

8. The flow control device of claim 1, wherein the piston, when disposed in the second position, and the valve, when disposed in the first position, provides a seal against fluid communication with the interior passageway of the tubular member.

9. A flow control device for control of fluid flow through a tubular member having an interior passageway for conveying fluids comprising:

a control chamber having a piston disposed therein, wherein the piston is moveable from an open piston position to a closed piston position by the application of a first fluid pressure on at least one face of the piston in fluid communication with the interior passageway; and a valve chamber having a valve therein, wherein the valve is moveable from a closed valve position to an open valve position by the application of a second fluid pressure;

wherein a seal preventing fluid flow through the control chamber into the tubular member is formed in the closed piston position, and wherein a flow path through the valve chamber and into the tubular member is formed in the open valve position.

10. The flow control device of claim 9, further comprising a restraining member configured to be actuated by movement of the piston in response to the first fluid pressure.

11. The flow control device of claim 9, further comprising a restraining member configured to be actuated by movement of the valve in response to the second fluid pressure.

12. The flow control device of claim 9, wherein the valve forms a seal against a fluid flow between at least a portion of the valve chamber and the tubular member during the application of the first fluid pressure.

13. The flow control device of claim 9, wherein a first flow path through the control chamber into the tubular member creates a first pressure drop, wherein a second flow path through the valve chamber into the tubular member creates a second pressure drop, and wherein the second pressure drop is less than the first pressure drop.

14. The flow control device of claim 9, wherein the second fluid pressure is greater than the first fluid pressure.

15. The flow control device of claim 9, further comprising a flow restrictor disposed within the control chamber, wherein the flow restrictor is configured to provide a helical flow path.

16. The flow control device of claim 9, further comprising a nozzle disposed within the control chamber.

17. A method for controlling flow into a tubular member comprising:

providing fluid communication between an interior of the tubular member and a subterranean formation along a first flow path;

substantially sealing the first flow path in response to a first pressure;

establishing a second flow path between the interior of the tubular member and the subterranean formation in response to a second pressure; and providing fluid communication between the interior of the tubular member and the subterranean formation along the second flow path;

wherein substantially sealing the first flow path comprises applying the first pressure to a flow restrictor disposed in the first flow path and to at least one face of a piston disposed in a first position, the at least one face being in fluid communication with the interior of the tubular member, translating the piston from the first position to a second position in response to the first pressure, and substantially sealing fluid flow through the flow restrictor and into the interior of the tubular member along the first flow path.

18. The method of claim 17, wherein establishing a second flow path comprises applying a second pressure greater than the first pressure to a valve, actuating the valve from a closed position to an open position in response to the second pressure, and flowing fluid through the valve into the interior of the tubular member through a second flow path.

19. The method of claim 17, wherein the first flow path is substantially sealed prior to establishing the second flow path.

* * * * *